US007549402B2

(12) United States Patent
Issler

(10) Patent No.: US 7,549,402 B2
(45) Date of Patent: Jun. 23, 2009

(54) PISTON SPRAY NOZZLE

(75) Inventor: Wolfgang Issler, Schwaikheim (DE)

(73) Assignee: Mahle International GmbH, Stuttgart (DE)

( * ) Notice: Subject to any disclaimer, the term of this patent is extended or adjusted under 35 U.S.C. 154(b) by 0 days.

(21) Appl. No.: 11/791,912

(22) PCT Filed: Nov. 28, 2005

(86) PCT No.: PCT/DE2005/002142

§ 371 (c)(1),
(2), (4) Date: Jul. 12, 2007

(87) PCT Pub. No.: WO2006/058523

PCT Pub. Date: Jun. 8, 2006

(65) Prior Publication Data

US 2008/0017139 A1 Jan. 24, 2008

(30) Foreign Application Priority Data

Nov. 30, 2004 (DE) ..... 10 2004 057 626

(51) Int. Cl.
*F01P 3/06* (2006.01)

(52) U.S. Cl. ..... 123/41.35

(58) Field of Classification Search ..... 123/41.35, 123/41.34, 41.36, 41.39, 41.56, 41.57
See application file for complete search history.

(56) References Cited

U.S. PATENT DOCUMENTS

| | | | | | |
|---|---|---|---|---|---|
| 1,612,372 | A * | 12/1926 | Gussman | ..... | 184/6.5 |
| 3,062,456 | A | 11/1962 | Thompson et al. | | |
| 3,602,434 | A * | 8/1971 | Hruby, Jr. | ..... | 239/424 |
| 4,067,307 | A * | 1/1978 | Hofle et al. | ..... | 123/41.35 |
| 4,408,575 | A * | 10/1983 | Clairmont et al. | ..... | 123/41.35 |
| 4,869,211 | A * | 9/1989 | Heberle et al. | ..... | 123/41.35 |
| 4,907,545 | A * | 3/1990 | Mills | ..... | 123/41.35 |
| 4,979,473 | A | 12/1990 | Lee | | |
| 5,881,684 | A * | 3/1999 | Bontaz | ..... | 123/41.35 |
| 6,672,261 | B1 * | 1/2004 | Svensson | ..... | 123/41.35 |
| 6,701,875 | B2 * | 3/2004 | Weng et al. | ..... | 123/41.35 |
| 7,086,354 | B2 * | 8/2006 | Dunbar et al. | ..... | 123/41.35 |

FOREIGN PATENT DOCUMENTS

| | | | |
|---|---|---|---|
| DE | 23 43 655 | A1 | 3/1975 |
| DE | 31 25 835 | | 1/1983 |
| DE | 690 14 274 | T2 | 4/1995 |
| DE | 196 34 742 | A1 | 3/1998 |
| FR | 653 697 | A | 3/1929 |
| WO | WO 82/02 575 | A1 | 8/1982 |
| WO | WO 01/14699 | A1 * | 3/2001 |
| WO | WO 2004/0 99 580 | A1 | 11/2004 |

OTHER PUBLICATIONS

International Search Report.

* cited by examiner

*Primary Examiner*—Michael Cuff
*Assistant Examiner*—Ka Chun Leung
(74) *Attorney, Agent, or Firm*—Collard & Roe, P.C.

(57) ABSTRACT

The invention relates to a piston spray nozzle (12, 112) for cooling a piston (10) of a combustion engine by means of a liquid jet (20, 120) that is directed to a cooling chamber (14) of the piston (10). According to the invention, a member (16, 116) that has an approximately round cross-section and provides the discharged liquid jet (20,12) with a substantially tubular shape is disposed in the center of the discharge port (15, 115) of the piston spray nozzle (12, 112). The inventive piston spray nozzle delivers a directed, laminar liquid jet who shape remains essentially the same until the jet hits the cooling area (14).

10 Claims, 1 Drawing Sheet

PISTON SPRAY NOZZLE

CROSS REFERENCE TO RELATED APPLICATIONS

Figure 1:
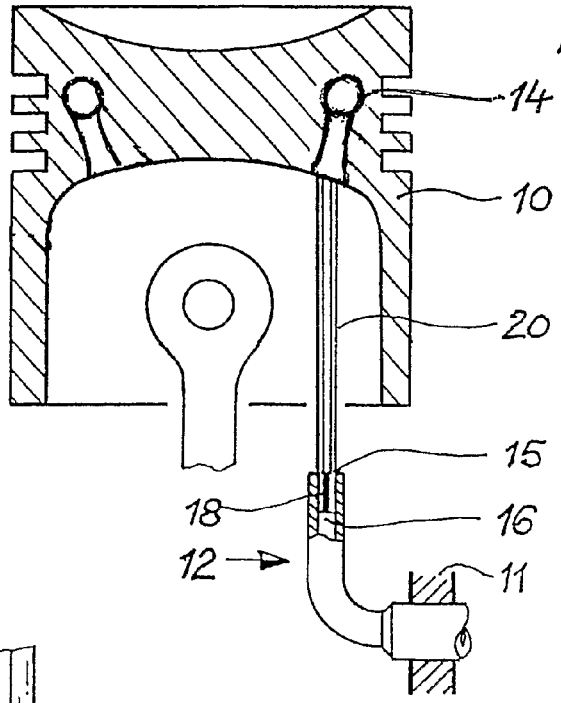

Applicant claims priority under 35 U.S.C. §119 of German Application No. DE 10 2004 057 626.2 filed Nov. 30, 2004. Applicant also claims priority under 35 U.S.C. §365 of PCT/DE2005/002142 filed Nov. 28, 2005. The international application under PCT article 21(2) was not published in English.

In internal combustion engines, the pistons are cooled in order to avoid overly high piston temperatures. Particularly in the case of pistons produced from light metal materials, overly high temperatures have the effect of reducing the long-term strength of the pistons. Furthermore, overly high temperatures cause a thermally related deposit of carbon as well as deposits in the piston ring grooves. Finally, at overly high temperatures, there is the possibility of a change in the original piston geometry.

A known measure for reducing the piston temperature consists of spraying a cooling surface of the piston, which can particularly be formed by the piston crown or a ring-shaped cooling chamber in the piston, for example with the lubricant oil out of the oil circuit of the internal combustion engine. For this purpose, piston spray nozzles are disposed in the region of the crankcase, which nozzles stand in connection with the lubricant oil circuit of the internal combustion engine. In this connection, the exit openings of the piston spray nozzles are oriented in such a manner that their fluid jet impacts the cooling surface or the inflow bore of the cooling chamber, respectively.

In practice, it has now been shown that with an increasing operating temperature of the internal combustion engine, it is difficult to maintain a bundled full jet of the cooling fluid, because the cooling fluid, particularly the lubricant oil, becomes thinner and thinner at an increasing temperature. Furthermore, the oil pressure, which increases as a result of the increasing temperature, results in fanning of the fluid jet, and this makes a targeted impact of a bundled fluid jet onto the cooling surface difficult.

A piston spray nozzle is known from the German Offenlegungsschrift DE 196 34 742 A1, in which at least two exit openings that lie parallel to one another are provided, which are configured as extended exit channels having a specific diameter, in order to produce laminar fluid jets.

A spray nozzle for piston cooling is known from the German patent DE 31 25 835 C2, in which the exit opening for the cooling fluid is formed by means of folding a pipe. In this connection, the shape of the exit opening deviates from the circular shape.

The present invention is based on the task of creating a piston spray nozzle for cooling pistons in internal combustion engines, which reliably produces a bundled, laminar fluid jet independent of the operating temperatures, and thereby allows effective cooling of the piston.

The solution consists of a piston spray nozzle having the characteristics of claim 1. According to the invention, it is provided that a body that is approximately circular in cross-section is disposed in the center of the exit opening of the piston spray nozzle, which body imparts an essentially tubular shape to the exiting fluid jet.

The piston spray nozzle according to the invention is characterized in that it produces a bundled, laminar fluid jet, which is essentially maintained until it impacts the cooling surface, or the cooling chamber of the piston, respectively, and does not fan out. This has its reason in that because of the speed of the fluid jet, the inside pressure in the "cavity" of the essentially tubular fluid jet is lower than the outside pressure that acts on the fluid jet from the outside. The pressure difference has the result that the bundling of the fluid jet is essentially maintained between the nozzle exit opening and the cooling surface of the piston, because the higher outside pressure counteracts fanning out of the fluid jet. With this inventive configuration of the piston spray nozzle, reliable and effective cooling of the piston, independent of the operating temperature of the internal combustion engine, is therefore achieved.

Advantageous further developments are evident from the dependent claims.

The body can end flush with the exit opening of the piston spray nozzle. However, it can also end above or below the exit opening of the piston spray nozzle. This variability makes it possible to optimally adapt the piston spray nozzle according to the invention to the requirements and the dimensions of the internal combustion engine in an individual case.

In a preferred embodiment of the present invention, the body is connected with the housing of the piston spray nozzle by means of at least one radial crosspiece. Even with this simple configuration of the piston spray nozzle according to the invention, in other words with the simplest means, stable shaping of the fluid jet is achieved.

Another preferred embodiment of the piston spray nozzle according to the invention consists in the fact that the body is a body configured in the form of a diaphragm ring. With such a body, the shaping of the fluid jet can be further optimized. A body in the form of a diaphragm ring can also be mounted in the housing of the piston spray nozzle in simple manner.

The body in the form of a diaphragm ring can have a central pin, for example, that is connected with a ring of the body in the form of a diaphragm ring by means of at least one radial crosspiece. This preferred embodiment of a body in the form of a diaphragm ring represents a compact component that merely has to be set into or pressed into the housing of the piston spray nozzle. In this way, assembly of the piston spray nozzle according to the invention is further simplified.

Another preferred variant of the piston spray nozzle according to the invention is brought about in that the body is formed by an air pipe held in the housing of the piston spray nozzle. In the case of such a variant, the pressure difference between the outside pressure and the inside pressure in the "cavity" of the fluid jet is particularly great, so that the shape of the fluid jet is stabilized even more effectively. This pressure difference is achieved by means of the speed of the air stream that additionally flows through the "cavity." In this case, it is practical if the air pipe is held in the wall of the housing in air-tight and fluid-tight manner.

Figure 2:
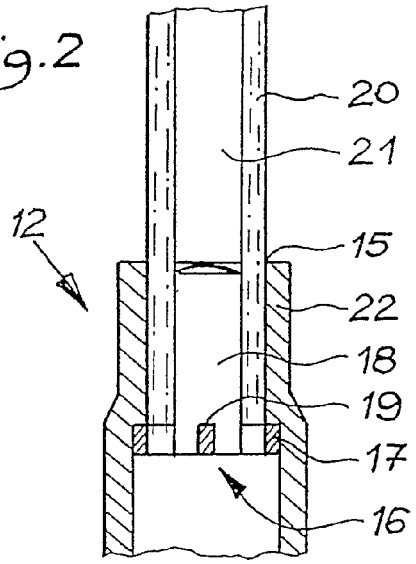
Figure 4:
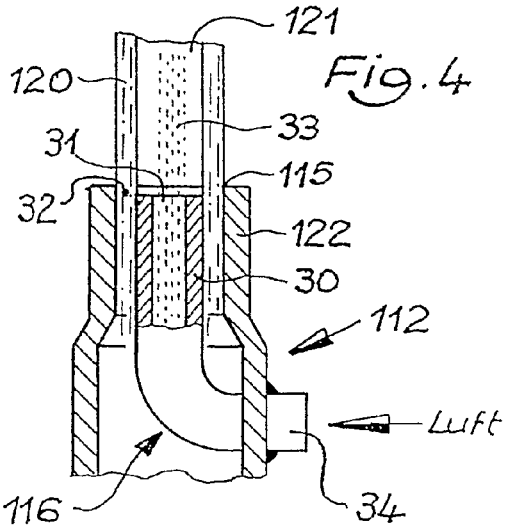
Figure 3:
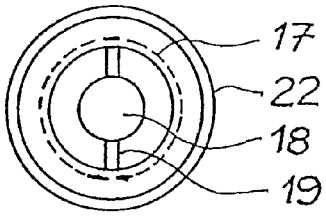
Figure 5:
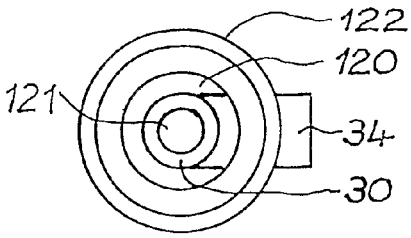

Exemplary embodiments of the invention will be described below, using the attached drawings. These show:

FIG. 1 a first exemplary embodiment of a piston spray nozzle according to the invention, in a schematic representation, not true to scale;

FIG. 2 an enlarged partial side view of the piston spray nozzle according to FIG. 1, in a schematic representation, not true to scale;

FIG. 3 the partial representation of the piston spray nozzle according to FIG. 2 in a top view;

FIG. 4 another exemplary embodiment of a piston spray nozzle according to the invention, in a schematic representation, not true to scale;

FIG. 5 the piston spray nozzle according to FIG. 4 in a top view;

FIG. 1 shows a piston 10 as used in internal combustion engines. During the operation of such pistons 10, very high temperatures occur, which have a damaging effect on the pistons 10 and also on the cylinder block 11 in which the pistons 10 work. In order to avoid the effects of the high temperatures on the pistons 10, the latter are cooled.

For this purpose, piston spray nozzles 12 are disposed in a cylinder block 11, by means of which nozzles a fluid jet 20, in each instance, is directed into a cooling chamber 14 disposed in the piston, for example, such as a cooling channel provided with a cooling oil inlet. This fluid jet 20 consists of the oil of the oil sump of the internal combustion engine and must travel a certain path distance from the piston spray nozzle 12 to the cooling chamber of the piston 10. In order to fill the cooling chamber with the fluid jet 20 most effectively, the jet should spread out as bundled as possible over as great a distance as possible, in other words in laminar manner.

FIGS. 1 to 3 now show a first exemplary embodiment of such a piston spray nozzle 12 according to the invention. The piston spray nozzle 12 has a housing 22 having an exit opening 15, into which a body 16 in the form of a diaphragm ring is inserted. The body 16 in the form of a diaphragm ring has a ring 17 and a central pin 18 that sits in this ring 17. It is practical if the pin 18 is connected with the ring 17 with only one radial crosspiece 19, in order to hold the ring in its central position in the exit opening 15. Arranging the body 16 in the form of a diaphragm ring in the center of the exit opening 15 has the result that the fluid jet 20 is shaped into a tubular jet.

In this connection, the pin 18 of the body 16 can be disposed in the center of the exit opening 15 in such a manner that it either ends flush with it or projects above it or ends below it—preferably slightly.

A body that corresponds to the pin 18 can also be disposed directly in the exit opening 15 of the piston spray nozzle 12 and be attached directly to the inside wall of the housing 22 by means of at least one crosspiece, for example (not shown).

The piston spray nozzle 12 according to the invention, in each of these embodiments, has the result that the exiting fluid jet 20, shaped in tubular manner, is essentially "compressed" as a result of the pressure difference between the greater outside pressure of the surroundings and the lower inside pressure that prevails in the "cavity" 21 of the fluid jet 20. This has the result that unintentional fanning out of the fluid jet 20 is prevented or at least delayed. As a result, significantly improved cooling of the piston 10 is possible.

FIGS. 4 and 5 show another exemplary embodiment of a piston spray nozzle 112 according to the invention, in which the body 116 disposed in the center of the exit opening 115 of the piston spray nozzle 112 consists of an air pipe 30. The air pipe 30 penetrates the housing 122 of the piston spray nozzle 112 laterally from the outside, with an arm 34. The air pipe is disposed in the center of the exit opening 115 for the fluid jet 120 provided in the housing 122 with its exit opening 31, forming a ring gap 32. The air pipe 30 stands in connection with the ambient air and is held in the housing 122 in air-tight and fluid-tight manner.

This inventive variant is based on the idea of producing a fluid jet 120 having an essentially tubular shape, by means of the air pipe 30 positioned in the exit opening 115, and, at the same time, entraining an air stream 33 into the "cavity" 121 of the fluid jet 120. In this manner, an air stream 33 is drawn in by the fluid jet 120 exiting from the exit opening 115, at the same time, which stream, because of its speed, at which it flows in the cavity 121, has a lower inside pressure as compared with the outside pressure prevailing in the surroundings. As a result of this pressure difference, the fluid jet 120 is essentially held together, and therefore impacts the cooling chamber run-in of the piston 10 as a bundled jet, and this significantly improves cooling.

The present invention therefore brings about reliable and effective cooling of the pistons.

The invention claimed is:

1. A piston spray nozzle for cooling a piston of an internal combustion engine by means of a fluid jet that is directed at a cooling chamber of the piston, said nozzle having a body configured in the form of a diaphragm ring that is approximately circular in cross-section disposed in a center of an exit opening of the piston spray nozzle, wherein said body causes the fluid jet to have an essentially tubular shape.

2. The piston spray nozzle according to claim 1, wherein the body ends flush with the exit opening of the piston spray nozzle.

3. The piston spray nozzle according to claim 1, wherein the body ends above or below the exit opening of the piston spray nozzle.

4. The piston spray nozzle according to claim 1, wherein the body is connected with the housing of the piston spray nozzle by means of at least one radial crosspiece.

5. The piston spray nozzle according to claim 1, wherein the body in the form of a diaphragm ring has a central pin that is connected with a ring of the body in the form of a diaphragm ring by means of at least one radial crosspiece.

6. A piston spray nozzle for cooling a piston of an internal combustion engine by means of a fluid jet that is directed at a cooling chamber of the piston, said nozzle having a body consisting of an air pipe held in a housing of the piston spray nozzle, said body being approximately circular in cross-section and being disposed in a center of an exit opening of the piston spray nozzle, wherein said body causes the fluid jet to have an essentially tubular shape.

7. The piston spray nozzle according to claim 6, wherein the air pipe penetrates a wall of the housing.

8. The piston spray nozzle according to claim 7, wherein the air pipe is held in the wall of the housing in an air-tight and fluid-tight manner.

9. The piston spray nozzle according to claim 6, wherein the body ends flush with the exit opening of the piston spray nozzle.

10. The piston spray nozzle according to claim 6, wherein the body ends above or below the exit opening of the piston spray nozzle.

* * * * *